US009767661B2

(12) United States Patent
Brav et al.

(10) Patent No.: US 9,767,661 B2
(45) Date of Patent: *Sep. 19, 2017

(54) DETECTION AND CLASSIFICATION OF ABNORMAL SOUNDS

(71) Applicant: Elwha LLC, Bellevue, WA (US)

(72) Inventors: Ehren J. Brav, Bainbridge Island, WA (US); Roderick A. Hyde, Redmond, WA (US); Yaroslav A. Urzhumov, Bellevue, WA (US); Thomas A. Weaver, San Mateo, CA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/209,130

(22) Filed: Jul. 13, 2016

(65) Prior Publication Data

US 2016/0321886 A1 Nov. 3, 2016

Related U.S. Application Data

(63) Continuation of application No. 14/562,282, filed on Dec. 5, 2014, now Pat. No. 9,396,632.

(51) Int. Cl.
*H04R 29/00* (2006.01)
*H04R 3/00* (2006.01)
(Continued)

(52) U.S. Cl.
CPC ..... *G08B 13/1672* (2013.01); *G08B 3/10* (2013.01); *G08B 13/19697* (2013.01); *G08B 21/02* (2013.01); *G08B 21/043* (2013.01); *G08B 21/0469* (2013.01); *G08B 29/188* (2013.01); *H04R 1/028* (2013.01); *G08B 17/00* (2013.01); *H04R 2420/07* (2013.01)

(58) Field of Classification Search
CPC ..... G08B 13/1672; G08B 13/19697; G08B 13/1654; G08B 13/194; G08B 13/196; G08B 17/00; G08B 19/00; G08B 19/005; G08B 21/02; G08B 21/043; G08B 21/0469; G08B 29/188; G08B 3/10; H04R 1/028; H04R 2420/07; H04R 3/00; H04R 3/12
See application file for complete search history.

(56) References Cited

U.S. PATENT DOCUMENTS 4,160,875 A 7/1979 Kahn
6,563,910 B2 5/2003 Menard et al.
(Continued)

*Primary Examiner* — Thang Tran
(74) *Attorney, Agent, or Firm* — Foley & Lardner LLP

(57) ABSTRACT

An audio surveillance system includes a plurality of nodes and each node includes a microphone, a speaker, and a control unit. The microphone is configured to detect sound and the speaker is configured to provide sound. The control unit is configured to receive a plurality of inputs from the plurality of nodes and the plurality of inputs are based on a detected sound; determine a location of the source of the detected sound based on the plurality of inputs; classify the detected sound according to predefined alert conditions and based on the location of the source of the detected sound; provide an alert to a monitoring device regarding the detected sound based on the classification of the detected sound; and control at least one node from the plurality of nodes to provide an audio response to the detected sound.

35 Claims, 6 Drawing Sheets

(51) Int. Cl.

| | |
|---|---|
| ***G08B 13/00*** | (2006.01) |
| ***G08B 13/16*** | (2006.01) |
| ***G08B 21/02*** | (2006.01) |
| ***G08B 21/04*** | (2006.01) |
| ***G08B 29/18*** | (2006.01) |
| ***G08B 3/10*** | (2006.01) |
| ***G08B 13/196*** | (2006.01) |
| ***H04R 1/02*** | (2006.01) |
| *G08B 17/00* | (2006.01) |

(56) References Cited

U.S. PATENT DOCUMENTS

| | | | | |
|---|---|---|---|---|
| 7,158,026 | B2 | 1/2007 | Feldkamp et al. | |
| 7,403,110 | B2 | 7/2008 | Albert et al. | |
| 8,059,150 | B2 | 11/2011 | Gal | |
| 9,396,632 | B2 * | 7/2016 | Brav | H04R 1/028 |
| 2002/0003470 | A1 | 1/2002 | Auerbach | |
| 2002/0118796 | A1 | 8/2002 | Menard et al. | |
| 2005/0088915 | A1 * | 4/2005 | Lapin | G01S 5/30 367/118 |
| 2005/0174229 | A1 | 8/2005 | Feldkamp et al. | |
| 2006/0004582 | A1 | 1/2006 | Claudatos et al. | |
| 2006/0227237 | A1 | 10/2006 | Kienzle et al. | |
| 2006/0256660 | A1 | 11/2006 | Berger | |
| 2006/0261979 | A1 | 11/2006 | Draaijer et al. | |
| 2007/0237358 | A1 | 10/2007 | Tseng et al. | |
| 2008/0062255 | A1 | 3/2008 | Gal | |
| 2009/0002494 | A1 | 1/2009 | Calhoun | |
| 2009/0243852 | A1 * | 10/2009 | Haupt | G08B 25/08 340/541 |
| 2010/0008515 | A1 | 1/2010 | Fulton et al. | |
| 2010/0128123 | A1 | 5/2010 | Dipoala | |
| 2012/0163610 | A1 | 6/2012 | Sakagami | |
| 2012/0229275 | A1 | 9/2012 | Mattern | |
| 2014/0313032 | A1 | 10/2014 | Sager et al. | |
| 2015/0350799 | A1 * | 12/2015 | Schnaare | H04R 29/00 381/56 |

* cited by examiner

DETECTION AND CLASSIFICATION OF ABNORMAL SOUNDS

CROSS-REFERENCE TO RELATED PATENT APPLICATIONS

This application is a continuation of U.S. patent application Ser. No. 14/562,282, filed Dec. 5, 2014, which is currently co-pending and incorporated herein by reference in its entirety and for all purposes.

BACKGROUND

Surveillance systems are used for a variety of purposes, including monitoring behavior, activities, or other observable information, and may be located in a variety of places, including inside banks, airports, at busy intersections, private homes and apartment complexes, manufacturing facilities, and commercial establishments open to the public, among others. People and spaces are typically monitored for purposes of influencing behavior or for providing protection, security, or peace of mind. Surveillance systems allow organizations, including governments and private companies, to recognize and monitor threats, to prevent and investigate criminal activities, and to respond to situations requiring intervention.

SUMMARY

One embodiment relates to an audio surveillance system including a plurality of nodes. Each node includes a microphone, a speaker, and a control unit. The microphone is configured to detect sound and the speaker is configured to provide sound. The control unit is configured to receive a plurality of inputs from the plurality of nodes, and the plurality of inputs are based on a detected sound; determine a location of the source of the detected sound based on the plurality of inputs; classify the detected sound according to predefined alert conditions and based on the location of the source of the detected sound; provide an alert to a monitoring device regarding the detected sound based on the classification of the detected sound; and control at least one node from the plurality of nodes to provide an audio response to the detected sound.

Another embodiment relates to an audio surveillance node. The node includes a microphone, a speaker, a wireless transceiver, and a control unit. The microphone is configured to detect sound and the speaker is configured to provide sound. The control unit is configured to receive a plurality of inputs, including a plurality of sound inputs based on a detected sound and a plurality of acoustic pulses transmitted by a second audio surveillance node; determine a location of the second audio surveillance node based on the plurality of acoustic pulses; determine a location of the source of the detected sound based on the plurality of sound inputs and the location of the second audio surveillance node; classify the detected sound according to predefined alert conditions and based on the location of the source of the detected sound; provide an alert to a monitoring device regarding the detected sound based on the classification of the detected sound; and provide an audio response to the detected sound.

Another embodiment relates to an audio surveillance system including a plurality of nodes. Each node includes a microphone, a camera, a speaker, and a control unit. The microphone is configured to detect sound, the camera is configured to capture an image, and the speaker is configured to provide sound. The control unit is configured to receive a plurality of inputs from the plurality of nodes, and the plurality of inputs are based on at least one of the detected sound and the captured image; determine a location of the source of the detected sound based on the plurality of inputs and further based on at least one of the detected sound and the captured image; classify the detected sound according to predefined alert conditions and based on the location of the source of the detected sound; provide an alert to a monitoring device regarding the detected sound based on the classification of the detected sound; and control at least one node from the plurality of nodes to provide an audio response to the detected sound.

Another embodiment relates to a method for detecting and classifying sounds. The method includes receiving, by a control unit, a plurality of inputs from a plurality of nodes, and the plurality of inputs are based on a detected sound; determining, by the control unit, a location of the source of the detected sound based on the plurality of inputs; classifying, by the control unit, the detected sound according to predefined alert conditions and based on the location of the source of the detected sound; providing, by the control unit, an alert to a monitoring device regarding the detected sound based on the classification of the detected sound; and controlling, by the control unit, at least one node from the plurality of nodes to provide an audio response to the detected sound.

Another embodiment relates to a method for detecting and classifying sounds. The method includes receiving, by a control unit, a plurality of inputs, including a plurality of sound inputs based on a detected sound and plurality of acoustic pulses transmitted by an audio surveillance node; determining, by the control unit, a location of the audio surveillance node based on the plurality of acoustic pulses; determining, by the control unit, a location of the source of the detected sound based on the plurality of sound inputs and based on the location of the audio surveillance node; classifying, by the control unit, the detected sound according to predefined alert conditions and based on the location of the source of the detected sound; providing, by the control unit, an alert to a monitoring device regarding the detected sound based on the classification of the detected sound; and controlling, by the control unit, a speaker to provide an audio response to the detected sound.

Another embodiment relates to a method for detecting and classifying sounds. The method includes receiving, by a control unit, a plurality of inputs from a plurality of nodes, and the plurality of inputs are based on at least one of a detected sound and a captured image; determining, by the control unit, a location of the source of the detected sound based on at least one of the detected sound and the captured image; classifying, by the control unit, the detected sound according to predefined alert conditions and based on the location of the source of the detected sound; providing, by the control unit, an alert to a monitoring device regarding the detected sound based on the classification of the detected sound; and controlling, by the control unit, at least one node from the plurality of nodes to provide an audio response to the detected sound.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
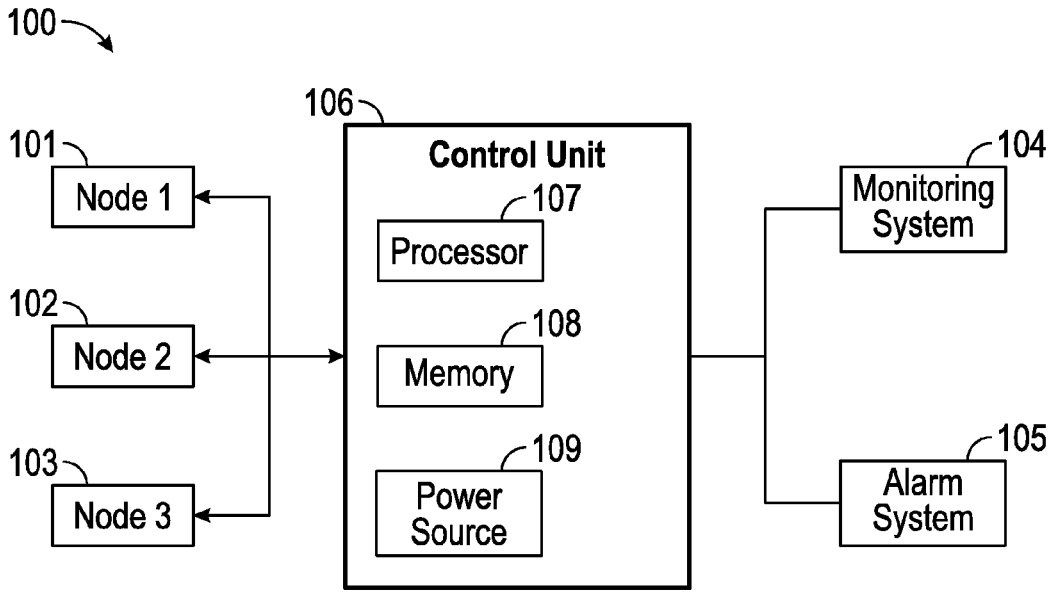
FIG. 1A is an illustration of an audio surveillance system according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to surveillance systems and methods, and more specifically, to detecting sound, determining a classification and location of sound, and reporting certain classified sounds to a monitoring device. Multiple sound detecting devices, otherwise referred to as "nodes," are typically spread throughout monitored areas. Varying numbers of nodes may be required to optimally monitor sounds in different sized areas or for different monitoring purposes. For example, only a few nodes (e.g., two or three) may be required to optimally monitor the well-being of a hospital patient in a hospital room. In another example, many nodes (e.g., one hundred or more) may be required to sufficiently monitor machinery, employees, vendors, etc. throughout a large manufacturing facility. In many cases, the number of nodes required for the systems and methods described herein will vary for different applications.

Generally, systems and methods for detecting and monitoring sound are shown according to various embodiments. Some surveillance systems, including security systems containing a plurality of cameras, feed video images to monitoring centers, which typically include a room containing either a monitoring screen for each security camera, or monitoring screens that display feeds from each security camera on a scrolling basis by, for example, changing the video feed every few seconds. In either case, monitoring display screens are typically watched by hired personnel. As these systems become larger, more and more monitoring personnel are needed to monitor each screen to adequately report or respond to activities or events. Furthermore, the cost of installing some security systems grows larger as more monitoring devices are installed due to installation requirements, such as mounting monitoring devices, running wires between monitoring devices and the monitoring center, and other construction or retrofitting requirements. Due to costs, some organizations that would otherwise greatly benefit from a large surveillance system limit the number of monitoring devices used, or forgo surveillance systems entirely, sometimes resulting in less oversight, dangerous working environments, or increased susceptibility to criminal activities.

According to various embodiments disclosed herein, a plurality of audio surveillance nodes (e.g., wirelessly connected nodes) include listening devices (e.g., microphone), speakers, wireless transceivers, memory, and/or control units. The audio surveillance nodes work cooperate to alert a monitoring device to situations requiring intervention and provide the monitoring device holder with an ability to vocally intervene, or direct personnel to the alert location to physically intervene. Accordingly, in some embodiments, anyone possessing a monitoring device is able to monitor a large number of audio surveillance nodes, sometimes while conducting other tasks, and quickly respond to situations requiring intervention, resulting in a more effective and economical surveillance system.

Referring now to FIG. 1A, audio surveillance system 100 is shown according to one embodiment. Audio surveillance system 100 includes a plurality of connected audio surveillance nodes, monitoring system 104, alarm system 105, and control unit 106. The plurality of connected audio surveillance nodes include first audio surveillance node 101, second audio surveillance node 102, and third audio surveillance node 103. Control unit 106 typically includes processor 107 and memory 108. Processor 107 may be implemented as a general-purpose processor, an application specific integrated circuit (ASIC), one or more field programmable gate arrays (FPGAs), a digital-signal-processor (DSP), a group of processing components, or other suitable electronic processing components. Memory 108 is one or more devices (e.g., RAM, ROM, Flash Memory, hard disk storage, etc.) for storing data and/or computer code for facilitating the various processes described herein. Memory 108 may be or include non-transient volatile memory or non-volatile memory. Memory 108 may include database components, object code components, script components, or any other type of information structure for supporting the various activities and information structures described herein. Memory 108 may be communicably connected to processor 107 and provide computer code or instructions to processor 107 for executing the processes described herein.

Control unit 106 is configured to receive inputs from various sources, including inputs from audio surveillance nodes 101, 102, 103 (e.g., inputs based on a sound detected by an audio surveillance node), inputs received from monitoring system 104, or inputs from alarm system 105, among others. Control unit 106 may receive inputs from any number of audio surveillance nodes. For example, control unit 106 may receive an input from first audio surveillance node 101 and second audio surveillance node 102 if both nodes detect a sound (e.g., two people arguing within microphone range of both audio surveillance nodes). As will be further discussed below, upon receiving inputs based on a detect sound, control system 106 may then determine the location of the source of the detected sound, classify the detected sound, provide an alert to monitoring system 104, and provide an audio response to the detected sound by controlling the speaker of an audio surveillance node near the source of the detected sound. The components and operation of the plurality of audio surveillance nodes and monitoring system 104 are described in further detail below.

In some embodiments, audio surveillance system 100 includes alarm system 105. Alarm system 105 may be a stand-alone system, such as an existing home security system, or be a component of monitoring system 104. In some embodiments, control unit 106 triggers alarm system 105 if a detected sound is classified such that setting off an alarm is desired. Alarm system 105 may be capable of generating different alarm types corresponding with different classifications of detected sound. For example, upon detecting a sound that is classified as an explosion, control unit 106 may cause alarm system 105 to trigger a fire alarm. In another example, upon detecting gasps for air in a hospital room, control unit 106 may cause alarm system 105 to trigger a "Code Blue" (signifying cardiac arrest) or other appropriate alarm at a nurse's station near the location of the detected sound. In some embodiments, alarm system 105 may trigger an audio message or sound from a speaker on one or more of audio surveillance nodes. In some embodiments, alarm system 105 is triggered by a user of a monitoring device associated with monitoring system 104.

Figure 1B:
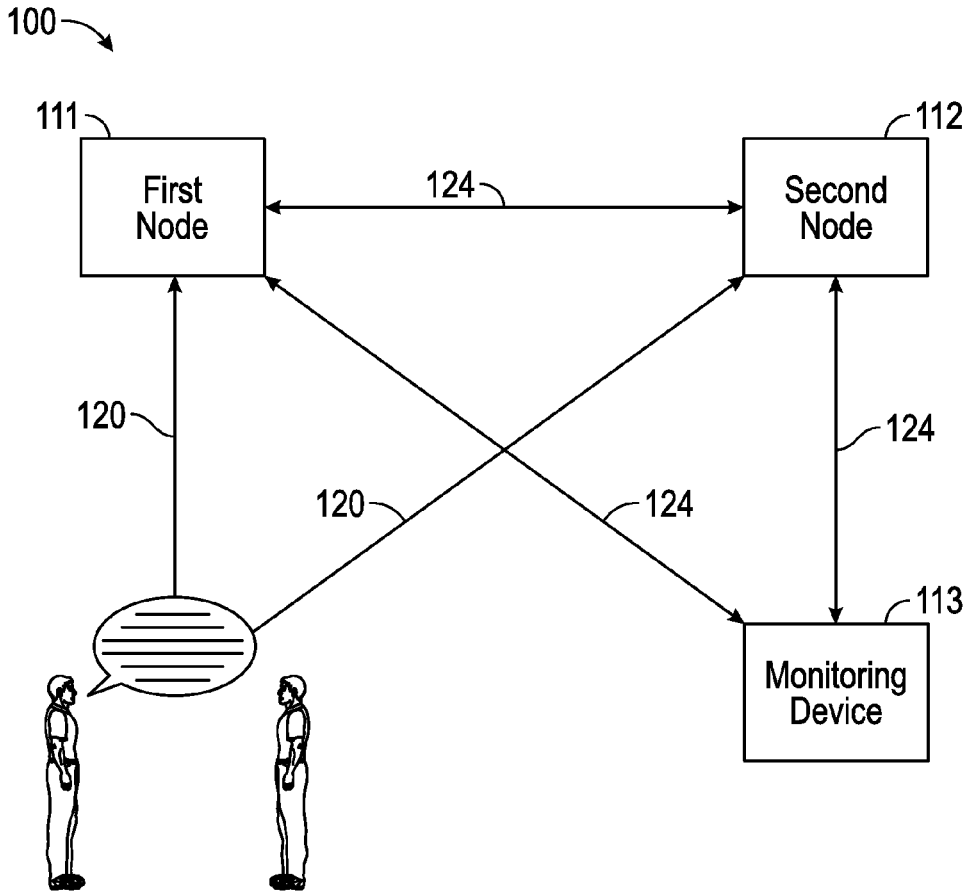
FIG. 1B is an illustration of an audio surveillance system according to another embodiment.

Referring now to FIG. 1B, audio surveillance system 100 is shown according to another embodiment. Audio surveillance system 100 includes a plurality of wirelessly connected audio surveillance nodes, including first audio surveillance node 111 and second audio surveillance node 112, and monitoring device 113. In some embodiments, each audio surveillance node contains the same elements of all other audio surveillance nodes and are therefore interchangeable with each other. It should be noted that while only first audio surveillance node 111 is described in detail, audio surveillance system 100 may include a plurality of audio surveillance nodes similar or identical to first audio surveillance node 111. Any of nodes 101, 102, 103, or the other nodes described herein may share features with node 111. In some embodiments, audio surveillance system 100 includes a plurality of audio surveillance nodes, each of which may contain additional elements, fewer elements, or the same elements as first audio surveillance node 111. In some embodiments, the elements of each of the audio surveillance nodes of the plurality of audio surveillance nodes are arranged in different ways.

Audio surveillance node 111 may be configured to be mounted to many different surfaces or objects, including walls, ceilings, floors, moveable furniture, and fixtures. Audio surveillance node 111 may be designed to blend in with surroundings (e.g., when discrete monitoring is preferred) or to stand out from its surroundings so that audio surveillance node 111 is clearly noticeable (e.g., to undermine criminal activities). For example, in one embodiment, audio surveillance node 111 is configured to be mounted underneath hospital beds, thereby enabling a hospital monitoring station to detect potential patient emergencies without alerting patients to the presence of the node. In another example, audio surveillance node 111 may project from the wall, thereby being noticeable to bystanders.

Figure 2A:
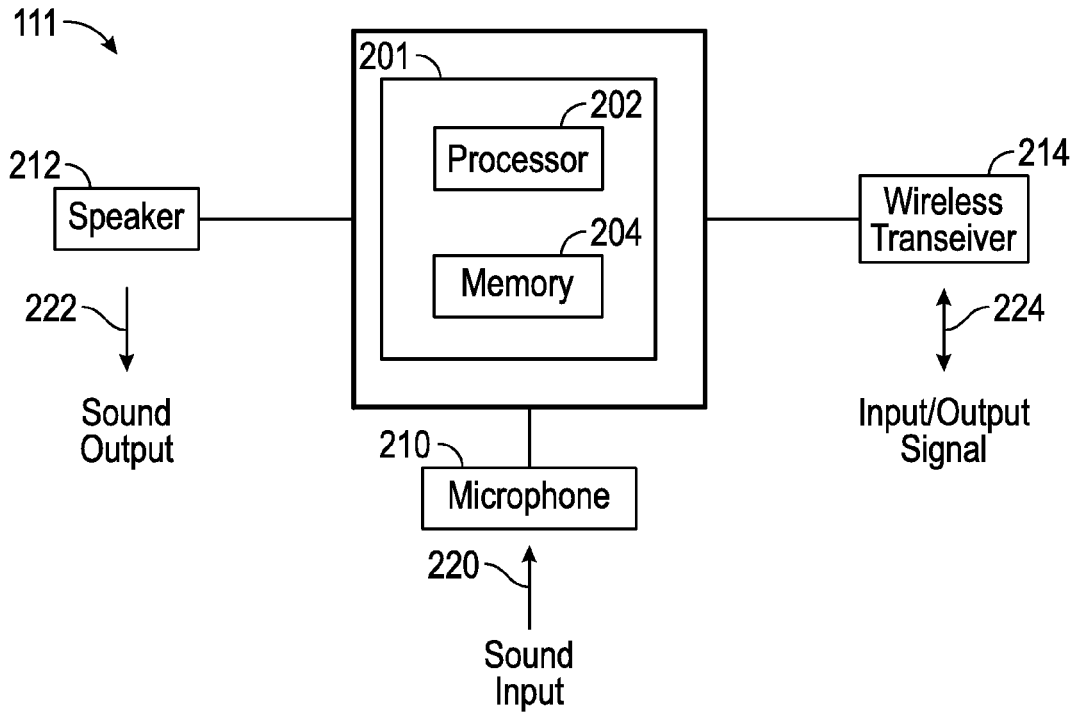
FIG. 2A is an illustration of an audio surveillance node according to one embodiment.

Referring now to FIG. 2A, audio surveillance node 111 is shown according to one embodiment. Audio surveillance node 111 includes control unit 201, microphone 210, speaker 212, and wireless transceiver 214. Control unit 201, in one embodiment, includes processor 202 and memory 204. Processor 202 may be implemented as a general-purpose processor, an application specific integrated circuit (ASIC), one or more field programmable gate arrays (FPGAs), a digital-signal-processor (DSP), a group of processing components, or other suitable electronic processing components. Memory 204 is one or more devices (e.g., RAM, ROM, Flash Memory, hard disk storage, etc.) for storing data and/or computer code for facilitating the various processes described herein. Memory 204 may be or include non-transient volatile memory or non-volatile memory. Memory 204 may include database components, object code components, script components, or any other type of information structure for supporting the various activities and information structures described herein. Memory 204 may be communicably connected to processor 202 and provide computer code or instructions to processor 202 for executing the processes described herein.

In one embodiment, control unit 201 is configured to receive a plurality of inputs, including a first input from microphone 210 of first audio surveillance node 111 based on a detected sound, and a second input from transceiver 214 of first audio surveillance node 111 based on the detected sound as detected by second audio surveillance node 112. Control unit 201 may also be configured to determine the location of the detected sound based on the plurality of received inputs, classify the detected sound according to predefined alert conditions, and control operation of transceiver 214 to send an alert to monitoring device 113 regarding the detected sound based on the classification of the detected sound. Control unit 201 may also be configured to control speaker 212 to provide an audio response to the detected sound based on a monitoring input received from monitoring device 113.

Microphone 210 may include dynamic, condenser, ribbon, crystal, or other types of microphones. Microphone 210 may include various directional properties, such that microphone 210 can receive sound inputs clearly. For example, microphone 210 may include omnidirectional, bidirectional, and unidirectional characteristics, where the directionality characteristics indicate the direction(s) in which microphone 210 may detect sound. For example, omnidirectional microphones pick up sound evenly or substantially evenly from all directions, bidirectional microphones pick up sound equally or substantially evenly from two opposite directions, and unidirectional microphones (e.g., shotgun microphones) pick up sound from only one basic direction. For example, in one embodiment, microphone 210 is mounted in the corner of a room and includes an omnidirectional microphone to detect sound in the entire room. In another embodiment, microphone 210 is mounted near a doorway and includes a unidirectional microphone aimed beyond the entrance such that sounds approaching the doorway are more readily detected. In some embodiments, microphone 210 may comprise an array of microphone elements, such as a beamforming array or a directional microphone array. The directionality of such microphone arrays may be based on a time delay introduced into signals from each microphone element. In some embodiments, time delays (and the resulting directionality) are implemented in hardware, while in other embodiments, time delays (and the resulting directionality) are software adjustable. In some embodiments, time delays may be both implemented in hardware and be software adjustable.

In operation, microphone 210 is configured to detect sound within range of audio surveillance node 111 and convert the detected sound into an electrical signal that is delivered to control unit 201. In some embodiments, microphone 210 is configured to be positioned toward a sound source. In some embodiments, microphone 210 is mounted on a spheroidal joint (e.g., a ball and socket joint). For example, upon detecting a sound and determining the sound's location, control unit 201 may direct microphone 210 (e.g., using a mechanical actuator to physically repoint the microphone, using software to change the directionality of a directional microphone array, etc.) such that microphone 210 points directly at, or at least at an angle closer to, the sound's location. In other embodiments, the direction microphone 210 points is fixed. Control unit 201 may automatically direct microphone 210 to point toward a detected sound or control unit 201 may direct microphone 210 only upon receiving a command to reposition microphone 210 from monitoring device 113. In some embodiments, control unit 201 may receive a command to direct microphone 210 from second audio surveillance node 112, or any other surveillance node from among a plurality of nodes.

Speaker 212 may include a wide angle speaker, a directional speaker, or a directional speaker using nonlinearly downconverted ultrasound. In some embodiments, nonlinearly downconverted ultrasound may be generated by nonlinear frequency downconversion in the air or in tissue near the ear of a listener. In some embodiments, nonlinearly downconverted ultrasound may be generated by beating together two ultrasound waves of different frequency near the listener to form an audio-frequency sound at the different resulting frequency. Speaker 212 may be a moving coil speaker, electrostatic speaker, or ribbon speaker. Speaker 212 may be horn-loaded. Speaker 212 may be an array speaker. In some embodiments the sound emission may be electronically steered by varying the sound emission time between elements of the array. In some embodiments, speaker 212 is configured to be directed (physically or electronically) such that speaker 212 is directed to project sound toward a sound source or directed toward bystanders to warn them of danger. For example, upon determining that a dangerous situation may exist for bystanders near audio surveillance node 111, control unit 201 may direct speaker 212 (e.g., using a mechanical actuator, using electronic steering, etc.) such that a warning sound will be heard by a maximum number of people.

In operation, speaker 212 is configured to convert an electrical signal received from control unit 201 into sound. Typically, speaker 212 provides an audio response to the sound detected by microphone 210. In some embodiments, speaker 212 automatically provides an audio response based on the classification of the detected sound. For example, upon detecting running in a school hallway and classifying the sound as a "low" alert, control unit 201 may not send an alert message to monitoring device 113, but instead automatically cause speaker 212 to play a prerecorded message (e.g., "No running in the hallway!"). In some embodiments, audio surveillance system 100 may provide two-way communication between audio surveillance node 111 and monitoring device 113. For example, upon audio surveillance node 111 detecting a situation that requires intervention, or a situation for which no message is prerecorded, a person may use monitoring device 113 to speak to anyone within listening range of audio surveillance node 111.

Figure 2B:
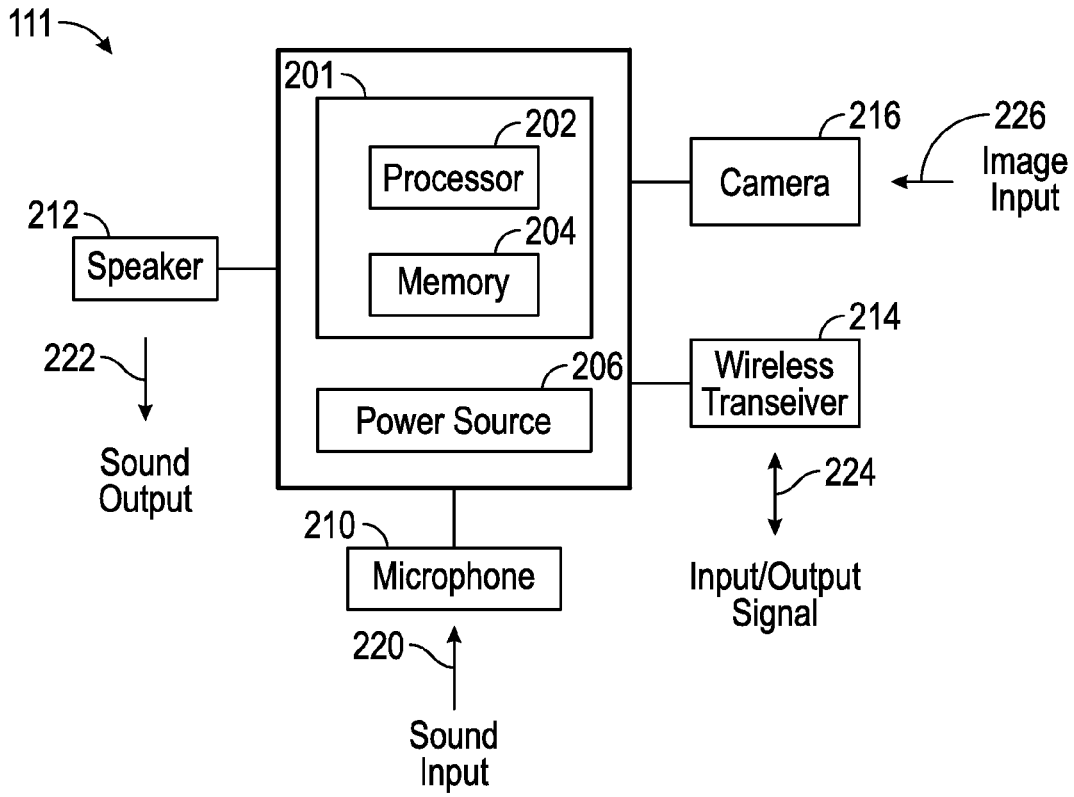
FIG. 2B is an illustration of an audio surveillance node according to another embodiment.

As shown in FIG. 2B, in one embodiment, in addition to control unit 201, microphone 210, speaker 212, and wireless transceiver 214, node 111 further includes power source 206 and camera 216. Audio surveillance node 111 may be wirelessly connected to other audio surveillance nodes, monitoring devices, and/or a central computer system, etc. Control unit 201 is configured to receive and send a plurality of inputs and outputs, including sound input 220 using microphone 210, sound output 222 using speaker 212, input/output signal 224 using wireless transceiver 214, and image input 226 using camera 216.

In one embodiment, audio surveillance node 111 is powered by power source 206. Power source 206 may be contained within the housing of audio surveillance node 111, or may be external to the housing. Power source 206 may include a battery. The battery may be a disposable battery, rechargeable battery, and/or removable battery. Power source 206 may be connected to an external power grid. For example, in one embodiment, power source 206 is plugged into a standard wall socket to receive alternating current. Power source 206 may also include a wireless connection for delivering power (e.g., direct induction, resonant magnetic induction, etc.). For example, power source 206 may be a coil configured to receive power through induction. Power source 206 may include a rechargeable battery configured to be recharged through wireless charging (e.g., inductive charging). Power source 206 may include a transformer. Power source 206 may be a capacitor that is configured to be charged by a wired or wireless source, one or more solar cells, or a metamaterial configured to provide power via microwaves. Power source 206 may also include any necessary voltage and current converters to supply power to control unit 201, microphone 210, speaker 212, wireless transceiver 214, and camera 216.

In one embodiment, audio surveillance node 111 includes camera 216. Camera 216 may be configured to capture still or video images. Camera 216 may be a digital camera, digital video camera, high definition camera, infrared camera, night-vision camera, spectral camera, or radar imaging device, among others. Camera 216 may include an image sensor device to convert optical images into electronic signals. Camera 216 may be configured to move in various directions, for example, to pan left and right, tilt up and down, or zoom in and out on a particular target.

In operation, camera 216 is configured to capture images and convert the captured images into an electrical signal that is provided to control unit 201. In some embodiments, camera 216 is controlled by control unit 201 to automatically capture images based on sound detected by microphone 210. Upon determining the location of detected sound, control unit 201 may position camera 216 to capture an image of the source location of the detected sound. In one embodiment, control unit 201 may use camera 216 to zoom in on the source location of the detected sound when appropriate (e.g., when the source of the detected sound is determined to be far away). In some embodiments, control unit 201 may reposition camera 216 only upon receiving a command to reposition camera 216 from monitoring device 113. In some embodiments, control unit 201 may receive a command to reposition camera 216 from second audio surveillance node 112, or any other surveillance node from among a plurality of nodes. In some embodiments, control unit 201 may use input from camera 216 to determine the location (direction and/or distance) of an object (e.g., a person) and to direct microphone 210 toward this location to improve sound detection from the object.

Referring back to FIG. 1B, one or more of the audio surveillance nodes are configured to communicate with other audio surveillance nodes as well as monitoring device 113. In some embodiments, multiple monitoring devices may receive communications from and send communications to the audio surveillance nodes. In one embodiment, first audio surveillance node 111, second audio surveillance node 112, and monitoring device 113 are each configured to send and receive input/output signals using a transceiver, for example, wireless transceiver 214. Wireless transceiver 214 may send and receive input/output signal 224 using a wireless network interface (e.g., 802.11a/b/g/n, CDMA, GSM, LTE, Bluetooth, ZigBee, 802.15, etc.), a wired network interface (e.g., an Ethernet port or powerband connection), or a combination thereof. In one embodiment, the plurality of audio surveillance nodes are wirelessly connected with one another. In some embodiments, some audio surveillance nodes are connected by hardwires while other nodes are wirelessly connected. In further embodiments, first audio surveillance node 111 communicates with second audio surveillance node 112 through a hardwired connection, but both nodes communicate with monitoring device 113 through a wireless connection.

Figure 3:
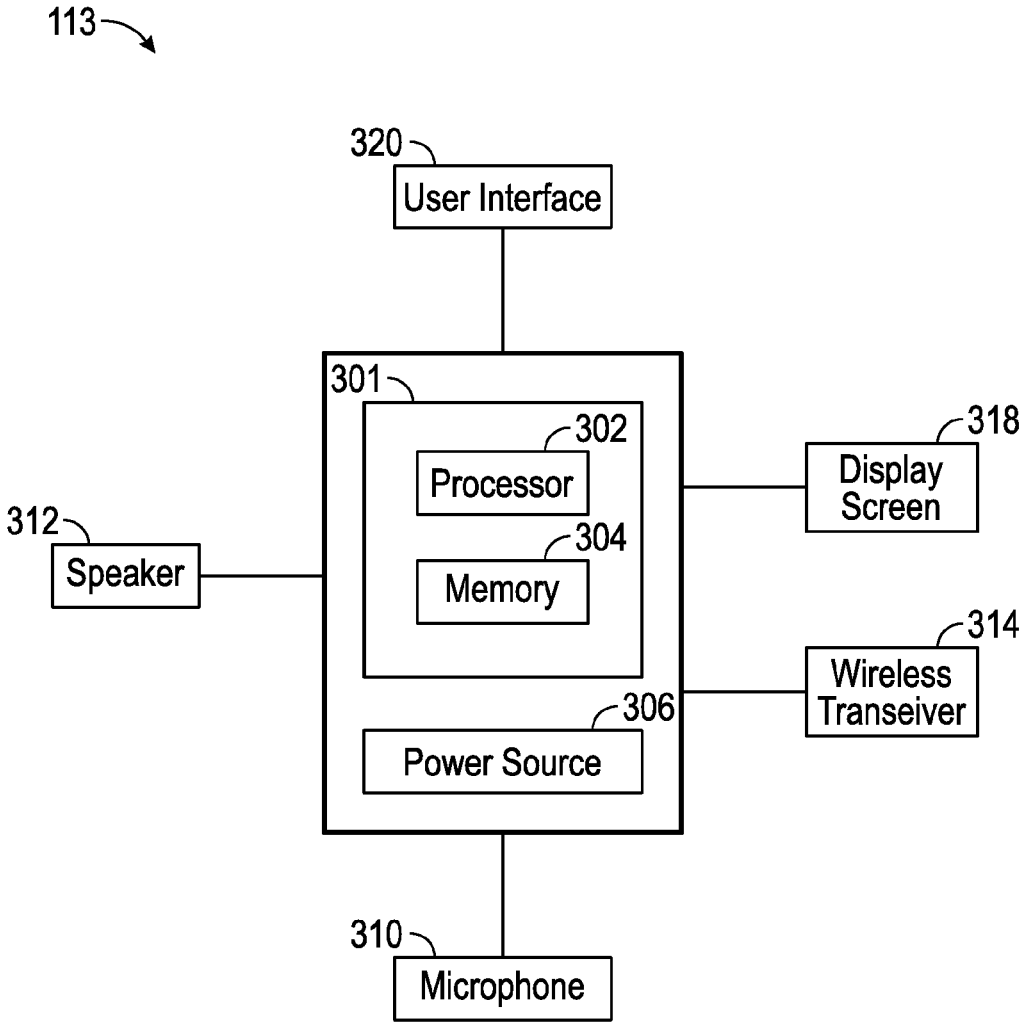
FIG. 3 is an illustration of a monitoring device according to one embodiment.

Referring to FIG. 3, monitoring device 113 is shown according to one embodiment. Monitoring device 113 includes control unit 301, power source 306, microphone 310, speaker 312, wireless transceiver 314, display screen 318, and user interface 320. Control unit 301 includes processor 302 and memory 304. Processor 302 may be implemented as a general-purpose processor, an application specific integrated circuit (ASIC), one or more field programmable gate arrays (FPGAs), a digital-signal-processor (DSP), a group of processing components, or other suitable electronic processing components. Memory 304 is one or more devices (e.g., RAM, ROM, Flash Memory, hard disk storage, etc.) for storing data and/or computer code for facilitating the various processes described herein. Memory 304 may be or include non-transient volatile memory or non-volatile memory. Memory 304 may include database components, object code components, script components, or any other type of information structure for supporting the various activities and information structures described herein. Memory 304 may be communicably connected to processor 302 and provide computer code or instructions to processor 302 for executing the processes described herein.

Monitoring device 113 may be a mobile device, smartphone, computer, tablet computer, personal digital assistant ("PDA"), watch, or virtual glasses, etc. Monitoring device 113 may be located on-site with a plurality of surveillance nodes or off-site at another location. Accordingly, monitoring device 113 may communicate directly with at least one of the plurality of surveillance nodes or indirectly through a wide area network, such as the Internet. For example, the principal of a school using an audio surveillance system may carry a monitoring device such that the principal may personally respond (e.g., verbally via an audio surveillance node, physically, etc.) to situations requiring intervention. In another example, a nurse station at a hospital may include a monitoring device in communication with only surveillance nodes on the same floor or in the same hospital unit. In another example, a security center of a large manufacturing facility may include a monitoring device in communication with thousands of surveillance nodes located throughout the facility.

Monitoring device 113 may include user interface 320. User interface 320 may be configured to allow a user to program or customize certain aspects of surveillance system 100. For example, user interface 320 may allow a user to establish a connection with an individual node (e.g., audio surveillance node 111) or multiples nodes of surveillance system 100 to define classification parameters or alert conditions. User interface 320 may be configured to allow a user to view stored information regarding detected sound. For example, a user may access audio files containing detected sounds and/or related images stored by surveillance nodes. User interface 320 may include display screen 318 and an input device (e.g., a keyboard, a mouse, touchscreen display). Monitoring device 113 may be configured to receive alerts from audio surveillance nodes. For example, upon the plurality of audio surveillance nodes detecting a sound of a certain classification, monitoring device 113 may receive an alert message indicating that human intervention is necessary. The alert message may include a recording of the detected sound, an image associated with the detected sound, a predetermined alert image, a predetermined alert sound, etc.

In one embodiment, monitoring device 113 is powered by power source 306. Power source 306 may be contained within housing of monitoring device 113 or may be external. Power source 306 may include a battery. The battery may be a disposable battery, rechargeable battery, and/or removable battery. Power source 306 may be connected to an external power grid. For example, in one embodiment, power source 306 is plugged into a standard wall socket to receive alternating current. Power source 306 may also include a wireless connection for delivering power (e.g., direct induction, resonant magnetic induction, etc.). For example, power source 306 may be a coil configured to receive power through induction. Power source 306 may include a rechargeable battery configured to be recharged through wireless charging (e.g., inductive charging). Power source 306 may include a transformer. Power source 306 may be a capacitor that is configured to be charged by a wired or wireless source, one or more solar cells, or a metamaterial configured to provide power via microwaves. Power source 306 may include any necessary voltage and current converters to supply power to control unit 301, microphone 310, speaker 312, wireless transceiver 314, display screen 318, and user interface 320.

Referring to FIG. 1B, first audio surveillance node 111 is configured to determine the location of a detected sound based on receiving sound input 120 and input/output signal 124 from second audio surveillance node 112. As shown in FIG. 1B, multiple surveillance nodes may detect and analyze sound originating from the same source. Upon analyzing the detected sound and receiving a signal based on the detected sound as detected and analyzed by second audio surveillance node 112, first audio surveillance node 111 uses sound localization techniques to determine the location of the sound source. For example, an audio surveillance node may determine the location of a sound based on characteristic differences in the sound as detected by first audio surveillance node 111 and at least one other audio surveillance node, such as differences in time of arrival, time of flight, frequency, intensity, Doppler shifts, spectral content, correlation analysis, pattern matching, and triangulation, etc. In some embodiments, any audio surveillance node of a plurality of audio surveillance nodes may determine the location of a sound detected by audio surveillance nodes. In some embodiments, an audio surveillance node is chosen to determine characteristics of the detected sound based on, for example, proximity to monitoring device 113. In some embodiments, each audio surveillance node that detects a particular sound may determine characteristics of the detected sound and, if appropriate, communicate an alert condition to monitoring device 113. Monitoring device 113 may receive a single alert from a single audio surveillance node, or multiple alerts from multiple audio surveillance nodes. In some embodiments, upon receiving multiple alerts from multiple audio surveillance nodes, monitoring device 113 may combine (e.g., using control unit 301) the alerts into a single status update.

In some embodiments, first audio surveillance node 111 may not be within communication range of every node in audio surveillance system 100 (e.g., wireless transceiver 214 may not be powerful enough to reach each node, a physical barrier may exist between the nodes, magnetic interference, etc.), in which case, first audio surveillance node 111 transmits input/output signal 224 to second audio surveillance node 112 (or any other node within range of first audio surveillance node 111), which relays input/output signal 224 to other nodes within its range. Likewise, in some audio surveillance systems, audio surveillance nodes may pass an alert intended for monitoring device 113 through other audio surveillances nodes before the alert is directly communicated to monitoring device 113.

In one embodiment, control unit 201 and/or audio surveillance node 111 are configured to determine the movement of a sound source. For example, control unit 201 may determine the movement of a sound source based on Doppler shifts in sound detected by microphone 210. In some embodiments, control unit 201 is configured to determine a velocity of the sound source (e.g., by combining Doppler shifts from different measurement directions, from determining changes in the location of the sound source between two closely spaced times, etc.). For example, upon receiving a plurality of inputs regarding a detected sound (e.g., from microphone 210 and wireless transceiver 214), control unit 201 determines the directional movement and velocity of the sound source based on characteristics of the detected sound, for example, time of arrival, frequency, intensity, Doppler shifts, spectral content, correlation analysis, pattern matching, and triangulation, etc. Audio surveillance node 111 may also receive inputs including information regarding moving audio shadows caused by a person blocking a portion of a sound source based on characteristics of the sound. For example, control unit 201 may determine if someone is standing between microphone 210 and the sound source based on the spectral content of the detected sound or based on differences in sound characteristics as detected by other audio surveillance nodes.

Each audio surveillance node of the plurality of audio surveillance nodes may be configured to determine the location of other audio surveillance nodes. In one embodiment, control unit 201 of audio surveillance node 111 is configured to transmit (e.g., using wireless transceiver 214) electromagnetic signals that are received by other nodes within range. Likewise, audio surveillance node 111 receives electromagnetic signals from other nodes within range. Based on the received signals, the control unit of each audio surveillance node is able to determine the location of the other audio surveillance nodes. In another embodiment, audio surveillance nodes may be configured to determine the location of other audio surveillance nodes by transmitting (e.g., by speaker 212) and receiving (e.g., by microphone 210) acoustic clicks or pulses. For example, each audio surveillance node of an audio surveillance system may be configured to broadly transmit the same acoustic click such that a receiving node may determine the transmitting node's location based on characteristics of the received acoustic click, such as frequency, intensity, Doppler shifts, spectral content, correlation analysis, pattern matching, and triangulation, etc. In one embodiment, a first transmitting node also transmits (via wireless transceiver 214) the emission-time of its transmitted acoustic pulse. This emission-time is received by the wireless transceiver of a second acoustic surveillance node and compared to the reception-time at which the second acoustic surveillance node receives the acoustic pulse with its microphone, thereby determining a time-of-flight for the pulse's travel from the first to the second node. Control unit 201 may be configured to receive such time-of-flight data for a number of node-to-node acoustic links. Control unit 201 may be further configured to compute a self-consistent 3-D configuration for the plurality of acoustic surveillance nodes. Each audio surveillance node of the plurality of audio surveillance nodes may be programmed to transmit an acoustic click at a certain time of day or after a predetermined interval of time, for example, one hour.

In one embodiment, control unit 201 is configured to classify the detected sound based on sound characteristics according to predefined alert conditions. Classifications may be based on the severity of an event related to a detected sound, the level of intervention required, etc. Memory 204 of control unit 201 may include one or more classification tables. Control unit 201 may classify detected sounds based on characteristics of the detected sound, such as pitch (i.e., frequency), quality, loudness, strength of sound (i.e., pressure amplitude, sound power, intensity, etc.), pressure fluctuations, wavelength, wave number, amplitude, speed of sound, direction, duration, and so on. In some embodiments, nodes may include analog-to-digital converters for translating analog sound waves into digital data.

The classification of a detected sound may determine what actions are taken by control unit 201. Based on a detected sound's classification, control unit 201 may send an alert to multiple monitoring devices. For example, upon detecting sound and classifying the detected sound as a gunshot (e.g., requiring police intervention and medical intervention), control unit 201 may send an alert to a monitoring device located near the detected sound as well as to a monitoring device located at a police station or ambulance dispatch center. An alert condition may also be based on an image condition, or a detected sound classification combined with an image condition. In some cases, requiring detection of certain image types to be associated with certain sound classifications before an alert is sent may, to a higher degree, assure that the alert condition is justified. For example, in some embodiments, upon detecting sound and classifying the detected sound as a gunshot, an audio surveillance node may require the detected sound to be accompanied by a flash of light (i.e., the flash of the gun firing) before an alert is sent to a monitoring device.

Generally, control unit 201 utilizes a plurality of classifications that may trigger different alert conditions; however, it will be appreciated that some systems may utilize only one alert condition (e.g., sounds above a certain loudness may). For example, in one embodiment, the classification system of an audio surveillance system located in a hospital may include five predefined alert conditions: no alert, low, moderate, high, and severe. A detected sound would be classified as a "no alert" condition when common sounds are detected by audio surveillance node 111, for example, soft conversation, stretcher wheels squeaking, a sneeze, etc. Typically, an alert would not be sent to monitoring device 113 for a "no alert" condition. A detected sound would be classified as a "low" alert condition when coughing becomes louder over time or a lunch tray slides off a patient's bed. Typically, an alert would not be sent to monitoring device 113 for a "low" alert condition. A detected sound would be classified as a "moderate" alert condition when an argument erupts, voices are raised, or glass breaks. An alert may be sent to monitoring device 113 for a "moderate" alert condition such that maintenance personnel can be dispatched to make repairs. A detected sound would be classified as a "high" alert when intense coughing suddenly erupts, a patient cries for help, choking sounds are detected, or other sounds typical of medical emergencies are detected. A "high" alert would cause an alert to be sent to monitoring device 113 such that a doctor, nurse, or other medical personnel may be dispatched to a patient or visitor in need. A detected sound would be classified as "severe" when the detected sound includes screams, a gunshot, or words of impending harm are yelled. A "severe" alert would cause an alert to be sent to monitoring device 113 such that a user may direct an appropriate response.

In one embodiment, control unit 201 is configured to store detected sound in memory based on the classification of the detected sound. The detected sound may be stored in memory contained in audio surveillance node 111 (e.g., memory 204), monitoring device 113, or in a database connected to audio surveillance system 100. In some embodiments, all detected sound is stored. In other embodiments, only sounds of certain classifications are stored. Audio surveillance node 111 may be configured to automatically record sound such that upon detecting sound of a certain classification, a portion of the recording is stored or sent to monitoring device 113. For example, in one embodiment, upon detecting a scream, audio surveillance node 111 stores all sound detected thirty seconds leading up to the scream and thirty seconds thereafter. In one embodiment, after a sound of a certain classification is detected, only ten seconds of sound before and after the sound is stored or sent to monitoring device 113. In one embodiment, audio surveillance node 111 overwrites previously recorded sounds. Audio surveillance system 100 may also be configured to store in memory still images or video images based on the classification of the detected sound if audio surveillance node 111 is equipped with an imaging device, such as camera 216.

In one embodiment, control unit 201 is configured to control operation of wireless transceiver 214 to send an alert to monitoring device 113. In some embodiments, alerts sent to monitoring device 113 relate to the classification of detected sound. Alert conditions may be based on different classifications depending on the location of audio surveillance system 100 and the purpose of the system. Alert conditions may be based on voices, glass breaking, running, falling, screams, fighting noises, gun shots, etc. Alert conditions may be further based on when sound of a particular classification is detected, including the time of day, day of the week, month, etc. For example, an audio surveillance system located in a hospital setting for purposes of patient safety may be configured to classify sounds based on sudden yells, gasps, choking, sudden shaking movements associated with a medical condition (e.g., heat attack, seizure, etc.) or cries for help. An audio surveillance system located in an automotive factory for purposes of employee safety may be configured to classify sounds based on sudden yells, falling metal, explosions, machinery short circuiting, or cries for help. An audio surveillance system located in a high school for purposes of student safety and discipline may be configured to classify sounds based on running in hallways, words associated with bullying, swear words, or noise in hallways during specific time periods (e.g., time periods in which students are expected to be in class). An audio surveillance system located in a nuclear power plant facility for purposes of security may be configured to classify sounds based on any noise occurring during certain time periods (e.g., after hours when employees are no longer present) or in certain places (e.g., near a perimeter fence or a power plant reactor). Classifications may be based on numerous factors particular to the purpose of audio surveillance system 100.

In some embodiments, the audio surveillance nodes automatically update predetermined alert conditions by machine learning. It will be appreciated that the audio surveillance system, and each individual node, may learn (e.g., modify operational parameters) based on input data received. The system, and nodes, may store data relating to sounds detected and actions taken by a monitoring device in response to certain types of sounds. For example, upon issuing several alerts over a period of time in response to detecting and locating a similar high-pitched screeching noise near a music room in a school, and upon receiving no response from a monitoring device for any of the alerts, the audio surveillance system may learn that such noises are acceptable (and thus do not require an alert) for at least the location and times of day in which the noises previously triggered alerts. In another example, the audio surveillance system may learn to ignore constant humming (or other noises typical of automobile assembly machinery) in an automotive assembly factory. In some embodiments, an audio surveillance system, or individual audio surveillance nodes, may connect to other systems, nodes, or databases to download and learn from the audio detection and response histories of other systems or nodes.

Figure 4:
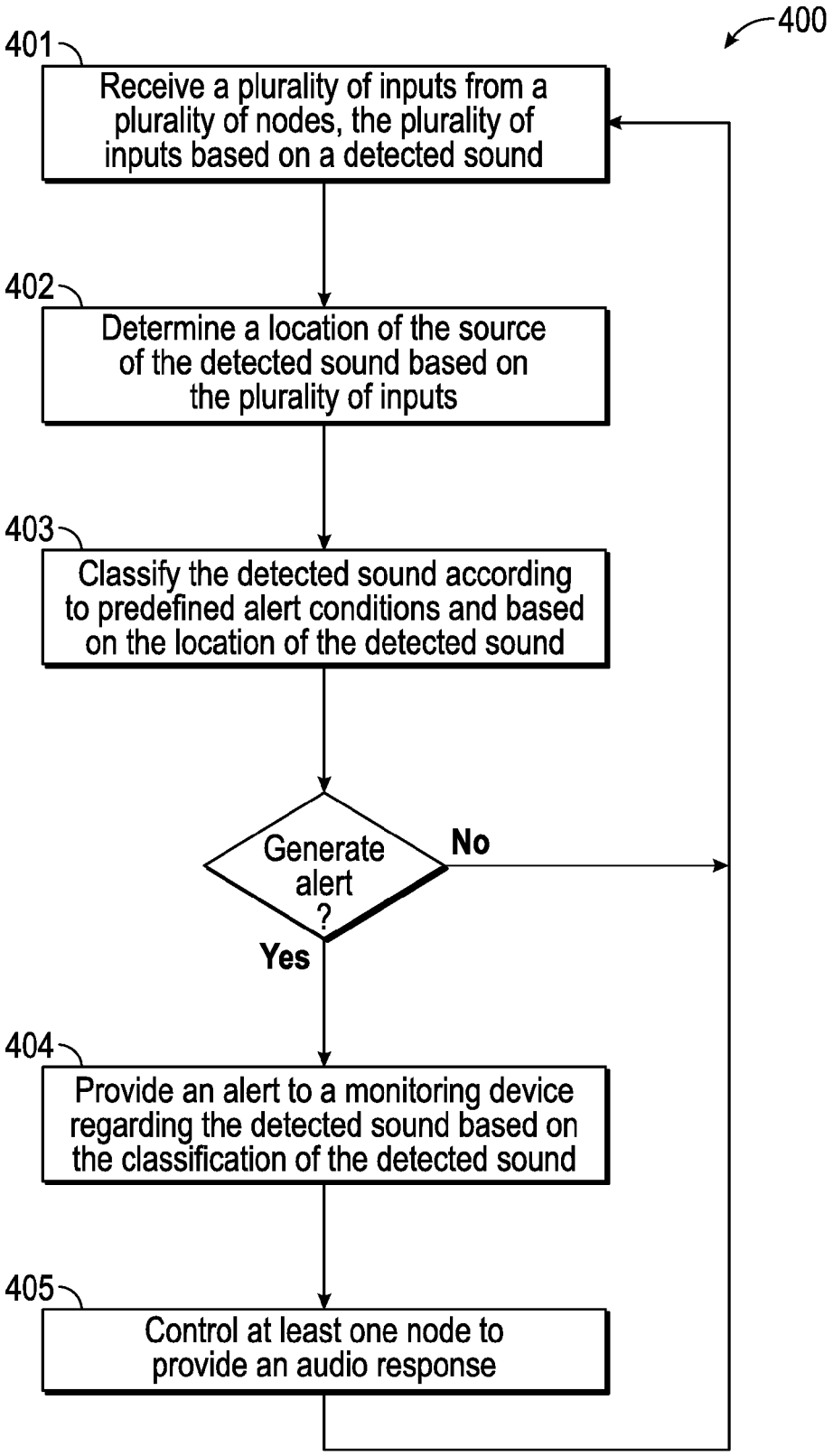
FIG. 4 is a diagram of a method for detecting and classifying abnormal sounds according to one embodiment.

Referring to FIG. 4, method 400 for detecting and classifying sounds is shown according to one embodiment. According to one embodiment, method 400 may be a computer-implemented method utilizing system 100. Method 400 may be implemented using any combination of computer hardware and software. According to one embodiment, a plurality of inputs are received from a plurality of nodes (401). The plurality of inputs are based on a detected sound. A location of the source of the detected sound is determined based on the plurality of inputs (402) (e.g., using localization techniques such as triangulation, etc.). The detected sound is classified according to predefined alert conditions and based on the plurality of inputs (403). In one embodiment, the detected sound is classified further based on the determination of the location of the source of the detected sound. An alert is provided to a monitoring device regarding the detected sound based on the classification of the detected sound (404) (e.g., an alert may be sent if the classification of the detected sound meets a predefined alert condition, including if the sound was detected in a certain location). At least one node from the plurality of nodes is controlled to provide an audio response to the detected sound (405). In some embodiments, a user may use the monitoring device to issue a verbal warning to a person who caused the sound that triggered the alert.

Figure 5:
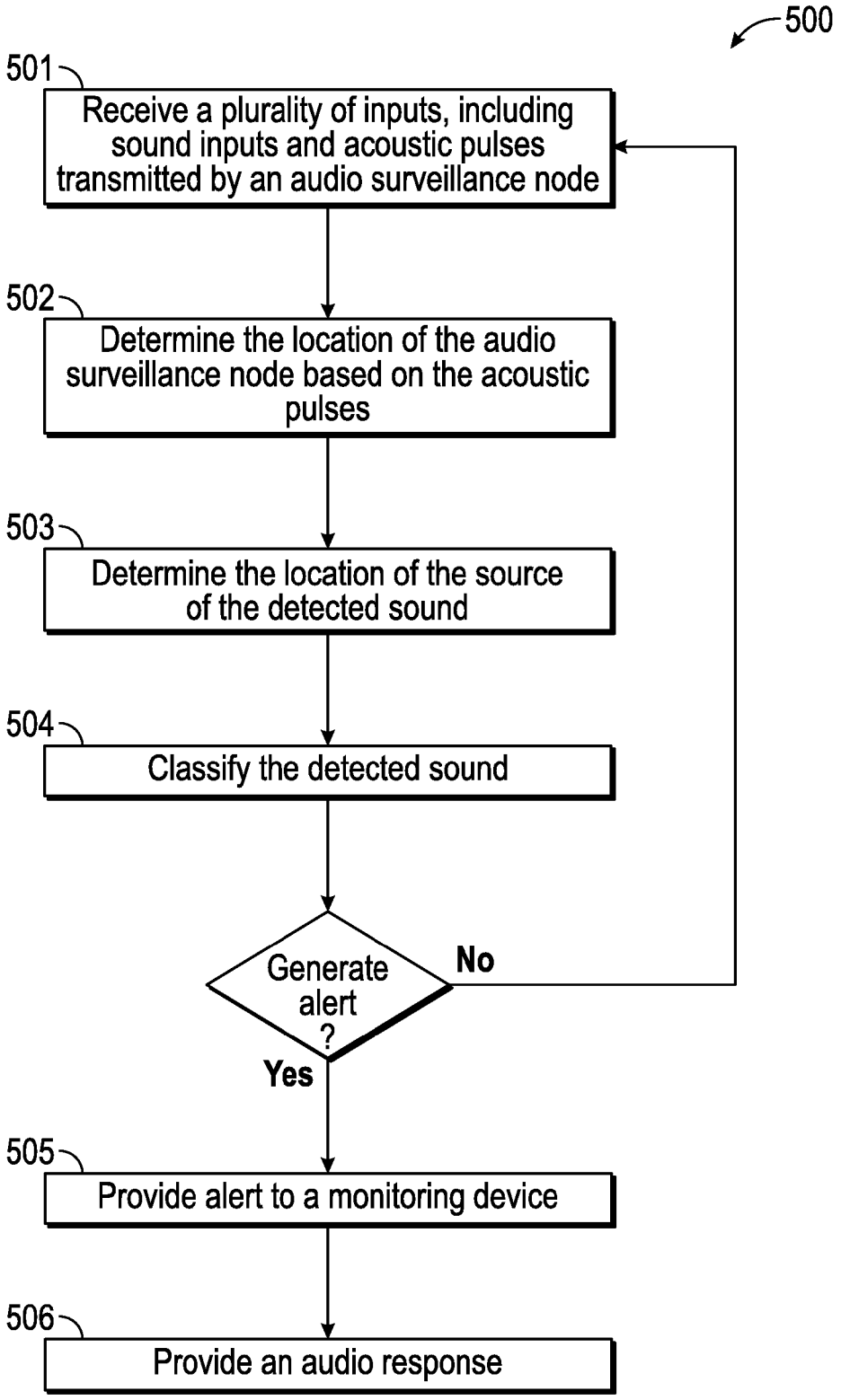
FIG. 5 is a diagram of a method for detecting and classifying abnormal sounds according to another embodiment.

Referring to FIG. 5, method 500 for detecting and classifying sounds is shown according to one embodiment. According to one embodiment, method 500 may be a computer-implemented method utilizing system 100. Method 500 may be implemented using any combination of computer hardware and software. According to one embodiment, a plurality of inputs are received, including a plurality of sound inputs based on a detected sound and a plurality of acoustic pulses transmitted by an audio surveillance node (501). The location of the audio surveillance node is determined based on the plurality of acoustic pulses (502). The location of the source of the detected sound is determined based on the plurality of sound inputs (503) (e.g., using localization techniques such as triangulation, etc.). The detected sound is classified according to predefined alert conditions and based on the plurality of sound inputs (504) (e.g., an alert may be sent only if the classification of the detected sound meets a predefined alert condition). In one embodiment, the detected sound is classified further based on the determination of the location of the source of the detected sound. An alert is provided to a monitoring device regarding the detected sound based on the classification of the detected sound (505) (e.g., an alert may be sent if the classification of the detected sound meets a predefined alert condition, including if the sound was detected in a certain location). An audio response to the detected sound is provided (506) (e.g., the acoustic pulses may be sent and received every few minutes, twice a day, once a week, etc.).

Figure 6:
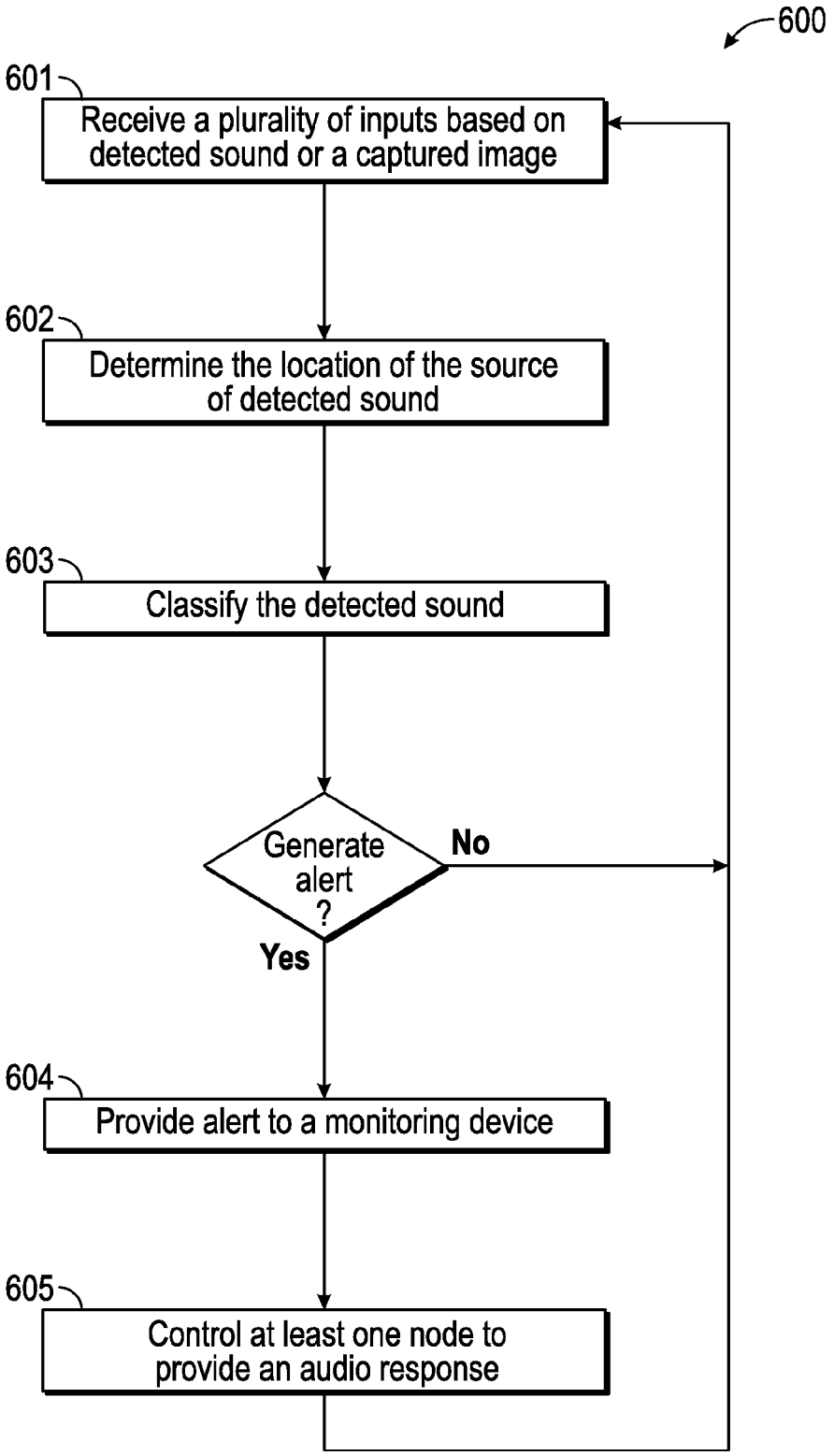
FIG. 6 is a diagram of a method for detecting and classifying abnormal sounds according to another embodiment.

Referring to FIG. 6, method 600 for detecting and classifying sounds is shown according to one embodiment.

According to one embodiment, method 600 may be a computer-implemented method utilizing system 100. Method 600 may be implemented using any combination of computer hardware and software. According to one embodiment, a plurality of inputs are received, where the plurality of inputs are based on at least one of a detected sound or a captured image (601). A location of the source of the detected sound is determined based on the plurality of inputs (602) (e.g., using localization techniques such as triangulation, etc.). The detected sound is classified according to predefined alert conditions and based on the plurality of inputs (603) (e.g., an alert may be sent only if the classification of the detected sound meets a predefined alert condition). In one embodiment, the detected sound is classified further based on the determination of the location of the source of the detected sound. In another embodiment, the detected sound is classified further based on the captured image. An alert is provided to a monitoring device regarding the detected sound based on the classification of the detected sound (604) (e.g., an alert may be sent if the classification of the detected sound meets a predefined alert condition, including if the sound was detected in a certain location and/or based on the captured image). At least one node from the plurality of nodes is controlled to provide an audio response to the detected sound (605) (e.g., in some cases, a user may use the monitoring device to issue a verbal warning to a person who caused the sound that triggered the alert).

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An audio surveillance node, comprising:

a microphone configured to detect sound and to detect acoustic pulses;

a speaker configured to provide sound and to emit acoustic pulses; and a control unit configured to:

receive a plurality of inputs, including a plurality of sound inputs based on a detected sound detected by the microphone and a plurality of acoustic pulses transmitted by a second audio surveillance node and detected by the microphone;

determine a location of the audio surveillance node relative to the second audio surveillance node based on the acoustic pulses detected by the microphone;

determine a location of the source of the detected sound based on the plurality of sound inputs and the location of the second audio surveillance node;

classify the detected sound according to predefined alert conditions and based on the determination of the location of the source of the detected sound;

provide an alert to a monitoring device regarding the detected sound based on the classification of the detected sound; and provide an audio response to the detected sound.

2. The audio surveillance node of claim 1, further comprising a wireless transceiver configured to transmit time-of-emission data for each emitted acoustic pulse and receive time-of-emission data for each detected acoustic pulse.

3. The audio surveillance node of claim 1, wherein the control unit is further configured to determine time-of-flight data for each detected acoustic pulse.

4. The audio surveillance node of claim 1, further comprising a wireless transceiver configured to transmit time-of-flight data for each detected acoustic pulse and receive time-of-emission data for a plurality of acoustic pulses detected by other audio surveillance nodes.

5. The audio surveillance node of claim 1, wherein the determination of the location of the audio surveillance node is based on a plurality of time-of-flight data.

6. The audio surveillance node of claim 1, further comprising a wireless transceiver configured to transmit a signal based on the detected sound and receive a signal indicative of the audio response.

7. The audio surveillance node of claim 1, wherein the alert includes an audio recording based on the detected sound.

8. The audio surveillance node of claim 1, wherein the alert includes at least one of a captured image and a video recording.

9. The audio surveillance node of claim 1, wherein the control unit is configured to determine the location of the source of the detected sound based on at least one sound characteristic from the group including time of arrival, relative intensity, relative spectral content, and triangulation.

10. The audio surveillance node of claim 1, wherein the control unit is further configured to automatically direct the microphone toward the location of the source of the detected sound.

11. The audio surveillance node of claim 1, further comprising a camera, wherein the camera is at least one of a video camera, a still camera, or a spectral camera.

12. The audio surveillance node of claim 11, wherein the control unit is further configured to automatically direct the camera toward the location of the source of the detected sound.

13. A method for detecting and classifying sounds, comprising:

receiving, by a control unit, a plurality of inputs from a plurality of nodes, wherein the plurality of inputs are based on a detected sound;

determining, by the control unit, a location of the source of the detected sound based on the plurality of inputs;

classifying, by the control unit, the detected sound according to predefined alert conditions and based on the location of the source of the detected sound;

providing, by the control unit, an alert to a monitoring device regarding the detected sound based on the classification of the detected sound; and controlling, by the control unit, at least one node from the plurality of nodes to provide an audio response to the detected sound.

14. The method of claim 13, further comprising transmitting a signal based on the detected sound and receiving a signal indicative of the audio response.

15. The method of claim 13, wherein the detected sound is detected by a microphone, and wherein the microphone is a directional microphone.

16. The method of claim 13, wherein the audio response is provided by a speaker, and wherein the speaker includes one of a wide angle speaker, a directional speaker, or a directional speaker using nonlinearly downconverted ultrasound.

17. The method of claim 13, wherein the plurality of inputs are further based on an image captured by a camera, wherein the camera is at least one of a video camera, a still camera, or a spectral camera.

18. The method of claim 17, further comprising automatically directing the microphone based on input from the camera.

19. The method of claim 13, wherein the predefined alert conditions include a sound condition and an image condition.

20. The method of claim 13, further comprising altering the predefined alert conditions based on a time of day.

21. The method of claim 13, further comprising applying a first alert condition to a first node and a second alert condition to a second node.

22. The method of claim 21, wherein the applied alert condition is based on the location of the node.

23. The method of claim 13, further comprising determining the location of at least some of the plurality of nodes based on acoustic pulses transmitted by a speaker and received by a microphone.

24. The method of claim 13, further comprising detecting a moving audio shadow caused by a person blocking a portion of a sound source.

25. A method for detecting and classifying sounds, comprising:

receiving, by a control unit, a plurality of inputs, including a plurality of sound inputs based on a detected sound and time-of-flight data for a plurality of acoustic pulses transmitted and received by different audio surveillance nodes;

determining, by the control unit, a location of an audio surveillance node based on the plurality of time-of-flight data;

determining, by the control unit, a location of the source of the detected sound based on the plurality of sound inputs and based on the location of the audio surveillance node;

classifying, by the control unit, the detected sound according to predefined alert conditions and based on the location of the source of the detected sound;

providing, by the control unit, an alert to a monitoring device regarding the detected sound based on the classification of the detected sound; and controlling, by the control unit, a speaker to provide an audio response to the detected sound.

26. The method of claim 25, wherein the predefined alert conditions include a sound condition and an image condition.

27. The method of claim 25, further comprising altering the predefined alert conditions based on a time of day.

28. The method of claim 25, wherein the predefined alert conditions include conditions based on at least one of voices, glass breaking, running, falling, screams, fighting noises, or gun shots.

29. The method of claim 25, further comprising determining a movement of a sound source based on Doppler shifts in sound.

30. The method of claim 25, further comprising determining a velocity of the sound source based on the plurality of inputs.

31. The method of claim 25, wherein the detected sound is detected by a microphone, and wherein the microphone is configured to detect sound only during a predefined time period.

32. The method of claim 31, wherein the predefined time period occurs once per second.

33. The method of claim 25, wherein the predefined alert conditions are updated based on the detected sound.

34. The method of claim 25, wherein the predefined alert conditions are further updated based on a monitoring input provided to the monitoring device.

35. The method of claim 25, further comprising providing an audio response to the detected sound based on at least one of the classification of the detected sound or a monitoring input received from the monitoring device.

* * * * *